US005205358A

United States Patent [19]

Mitzlaff

[11] Patent Number: 5,205,358

[45] Date of Patent: Apr. 27, 1993

[54] PIPE PLUGGING SYSTEM

[76] Inventor: Darald D. Mitzlaff, 2805 Hanscom Blvd., Omaha, Nebr. 68105

[21] Appl. No.: 730,651

[22] Filed: Jul. 16, 1991

[51] Int. Cl.[5] ..... E21B 33/127

[52] U.S. Cl. ..... 166/187; 166/387; 166/386

[58] Field of Search ..... 166/187, 122, 387, 192, 166/386

[56] References Cited

U.S. PATENT DOCUMENTS

| | | | |
|---|---|---|---|
| 1,342,927 | 6/1920 | Ruthven | 166/187 |
| 1,828,381 | 10/1931 | Schuyler | 166/187 |
| 2,314,540 | 3/1943 | Huntington | 166/187 X |
| 2,872,230 | 2/1959 | Desbrandes | 166/187 X |
| 2,978,029 | 4/1961 | O'Reilly et al. | 166/187 X |
| 3,050,118 | 8/1962 | Elkins | 166/187 X |
| 3,125,163 | 3/1964 | Smith | 166/187 |
| 3,130,787 | 4/1964 | Mason | 166/187 |
| 3,301,329 | 1/1967 | Martin | 166/187 |
| 3,995,694 | 12/1976 | Freiburger | 166/187 X |

*Primary Examiner*—Stephen J. Novosad

[57] ABSTRACT

A pipe plugging system useful for plugging oil well pipes for stopping oil flow from an oil well pipe. An inflatable plug is insertable on a tube through the top of the pipe and is inflated by a fluid under pressure released into he plug to expand the plug against the pipe wall. A blocker at the lower end of a carrier conduit expands out to block upward expansion of the flexible plug to force the plug to press against the inside the oil pipe on all sides. A gauge valve is installed on the pipe, to control oil flow, while the well pipe is held shut by the plug. A check valve, installed in the top of the tube, holds pressure in the tube, but is openable by pressure from a remotely controlled valve opening assembly to deflate the plug for tube removal, leaving the pipe closable by the check valve to control flow through the pipe into useful places. A guide removably placed around the tube guides the tube into an oil well casing deep in a pool of oil.

13 Claims, 4 Drawing Sheets

PIPE PLUGGING SYSTEM

THE FIELD OF THE INVENTION

This invention is in the field of pipe plugging and more particularly in the field of the plugging of oil well casings which have been broken off above or below ground.

BACKGROUND

The prior art has used many methods of stopping the wild gushing of oil or gas from well casings. The way used in Kuwait after the war with Iraq is to pump large volumes of mud or cement down the well casing to make it quit flowing.

This method then requires expensive removal of the mud or concrete, such as by drilling.

Not only is this expensive, but is consumes much time. Hundreds of oil well casings have been broken off in Kuwait, many of them below ground where the top of the casing is covered by a pool of oil and cannot be seen.

The plugging system hereof provides the concept of an inflatable plug on a tube, the tube being inserted in the well and then the plug is expanded with a fluid such as water or a gas to stop the flow. The prior art has many concepts involving the use of inflatable plugs. But in all cases there are major differences in principle and structure from the system hereof.

Oil pressure is very great and the concept of a restrainer of stiff material is provided to hold the flexible plug in place against great pressure.

Remote control of release of pressure into the tube and from the tube are concepts provided herein.

For plugging oil wells on massive scale, it is important that an expensive crane not be tied up in working at a single well location except for a very short time. For that reason a two-clamp tube holder concept is provided herein, holding the inserted tube to the oil well casing so that the crane is freed to be moved to a different well until needed for the tube and plug removal.

When an oil well casing has been broken off deep in the ground, such as by a vandalism explosion, the system hereof is excellent. The plugging can be done by passing the plug tube down through the oil puddle above the casing, though the casing cannot be seen as this makes great difficulty. However to assist emplacement of the plug-tube into an underground well casing, a first step can be to lower a special funnel toward the casing. This can be done by attaching the funnel around the plug-tube. The wide downward end of the funnel is easier to guide onto the casing than the narrower plug-tube. As the funnel has a long support frame extending upward, the funnel frame can be put around the plug tube and then both are lowered together until the funnel engages the casing. The funnel then guides the plug into the casing.

The special funnel is then removed horizontally from the plug-tube by first opening hinging sections of the funnel and its frame. The funnel is then lifted out of the way.

After the flow has been stopped with the system hereof by the use of a gate stop valve, then a globe valve, not shown, can be put above, and attached to, the gate stop valve.

A globe valve is better for day-to-day flow regulation than a stop valve.

BRIEF DESCRIPTION OF THE DRAWINGS

FIG. 8 shows at its top, the plug of FIG. 6 in dotted lines. At the bottom of FIG. 8 is the same housing as seen in FIG. 6 but shown in dotted lines with the ball-pressing system hereof in a pressure release position.

DESCRIPTION OF THE PREFERRED EMBODIMENT

Figure 1:
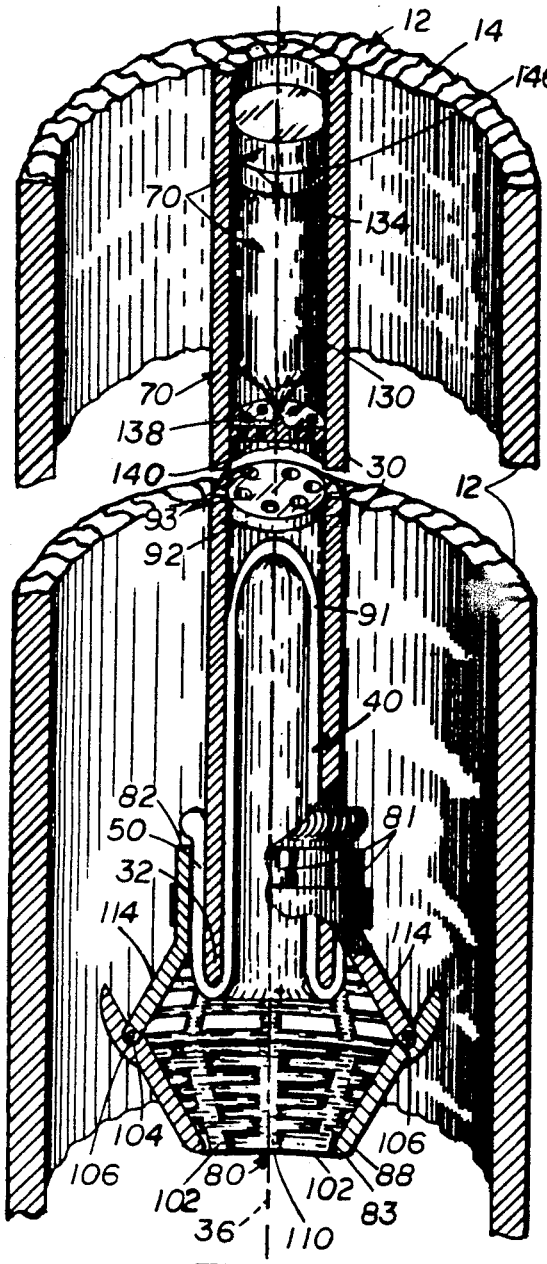
FIG. 1 is a side elevation of an oil well casing with the pipe plugging system hereof inserted therein. Certain forward parts of the system and of the casing are broken away. The plug is shown in storage position.

The pipe plugging system, or plugger 10 of this invention is shown in FIG. 1 and is for plugging a pipe 12 having an outer upper end 14 which is open and accessible.

Figure 2:
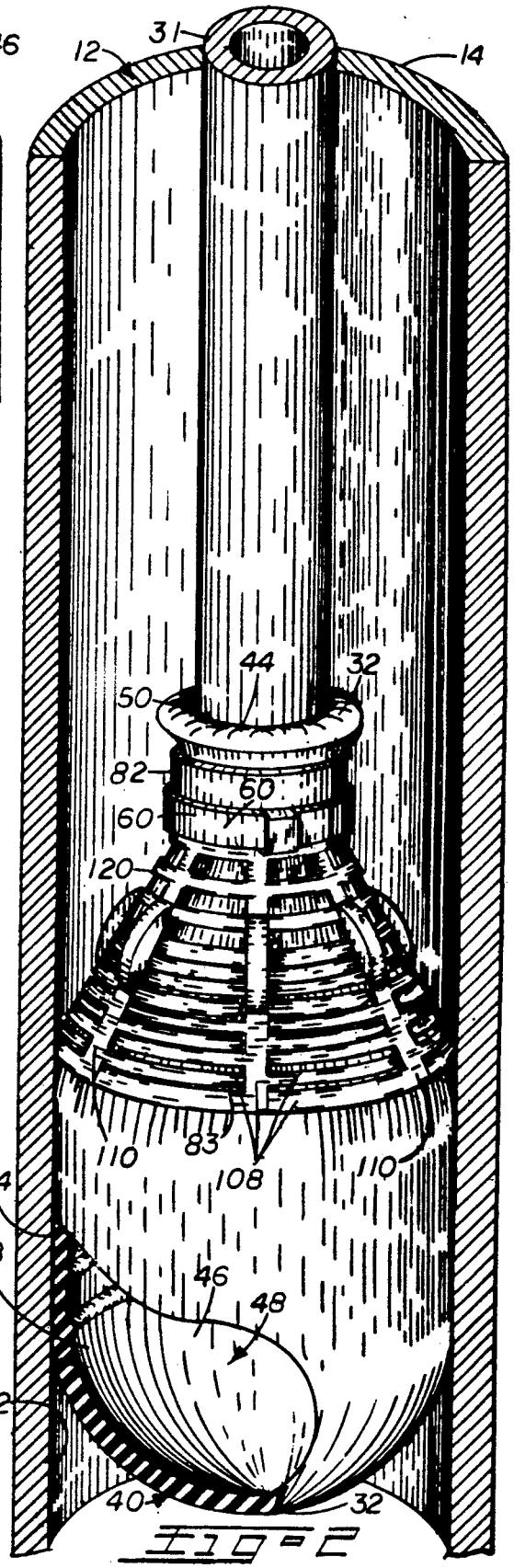
FIG. 2 is a detail of the lower parts of FIG. 1 with portions broken away. The plug is shown in inflated, plugging position.
Figure 3:
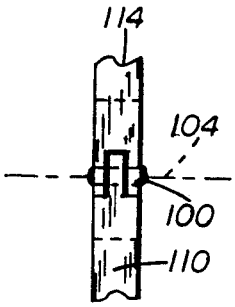
FIG. 3 is a view of a hinge connection with part of a hand and a connected path of the upper restrainer portion, as seen from the central axis of the plug tube.
Figure 4:
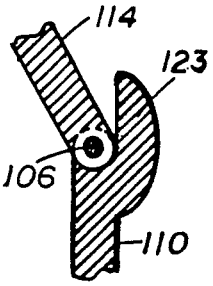
FIG. 4 is a view in section of the parts of FIG. 3 as seen on a plane at a right angle to a pivot pin and through a center between the ends of the pivot pin.

The pipe 12 can be the casing 12 of an oil well from which upper parts have been previously removed by intention or by vandalism as in war. A broken rough surface is shown at the end 14 in FIG. 1. In FIG. 2 the end has been cut in a horizontal plane.

The outer upper end 14 of the pipe 12 is open and is accessible either above ground or by digging down to it.

A plug-carrying-tube 30 of this invention has an inner lower end 32 considerably into the pipe 12. The inner lower end of the tube 30, in fact the whole tube 30 most likely, is straight, whereby the tube 30 can be said to have a usually vertical central axis 36 inside the pipe 12.

In FIG. 2 an inflatable flexible plug 40 has an inner end 32 and an outer end 44, when the plug 40 is inflated.

The plug 40 has its outer upper end 44 open and its inner lower end 32 closed. The upper outer end 44 of the plug 40 has a hollow neck 50, FIG. 1.

The plug neck 50 is disposed around the inner lower end of the tube 30 whereby the plug neck 50 can receive plug inflation fluid, such as an expandable gas, from the tube 30.

In FIGS. 1 and 2, the plug neck 50 is received around the inner lower end of the tube 30 and is clamped thereagainst by a suitable attaching clamp 60, which extends around the outer upper end of a restrainer 80, whereby the clamp 60 holds both restrainer 80 and tube 30 onto the pipe 12.

The restrainer 80 has an upper outer collar portion 82 which is actually in horizontally spaced sections 81 whereby the sections 81 can move so that they can be effectively clamped against the tube 30.

An inflation assembly 70, seen only in FIG. 1, delivers gas or other fluid under pressure into the plug 40 to inflate an inner lower portion of the plug whereby the pipe or well casing 12 becomes plugged by expansion of the inner lower end portion of the plug out against the inner side wall of the pipe 12.

The restrainer 80 has a lower end section which surrounds a portion of the plug 40 during pipe-plugging-plug-inflated times.

The restrainer 80 has an inner lower end 83 farthest from the outer upper end 31 of the tube 30.

The inner lower end 83 of the restrainer 80 is movable with respect to the central axis 36 of the tube 30, and capable of assuming a contracted position, as in FIG. 1, during plug-deflated times, with all parts of an innermost portion 88, FIG. 1, of the restrainer 80 closer to the axis 36 of the tube 30 and is also capable of assuming an expanded restraining position with all parts of the inner end 32 of the restrainer 80 farther from the central axis 36 of the tube 30.

In FIG. 1 the central portion 91 of the plug 40 is shown in its upper-outer storage position extending upwardly into the lower end of the tube 30. To prevent the central plug portion 91 from being pressed upwardly to excess by oil pressure force, a perforated holder 92 is fixed to the tube 30 and extends horizontally across the tube 30 interior to limit upward stretching of the plug central portion.

The perforated holder 92 has vertical holes 93 therethrough permitting inflation air to pass through.

The restrainer 80 surrounds an outer portion of the plug 40 whereby a portion of the plug can move, during plug inflation through the restrainer 80.

The plug 80 has a peripheral portion 84, FIG. 2, spaced from the axis 36 during plug-inflated times. When the lower end of the restrainer 80 is in restraining position and the plug 40 is in an inflated state, the restrainer 40 is capable of blocking the plug 40 so that the majority of the periphery portion of the plug substantially cannot pass into unwanted positions on the outer side of the restrainer 40 above the lower end of the restrainer when the pipe to be plugged is of such a size as to provide a close fit with respect to the lower end of the restrainer 40.

The restrainer lower portion 88, FIG. 1, has many hands 102, each pivoted about a horizontal wrist-axis 104 tangential to the tube axis 36 and at one of many pivot pins 106 each holding one of many hands 102.

The hands 102 each have vertically spaced fingers 108, FIG. 2, which extend out horizontally to two opposite sides of a slender palm 110.

Each palm 110 is held by a pivot pin 106 to one of many legs 114 extending downwardly and inwardly from an upper restrainer portion 120, FIG. 2.

The fingers 108 of each hand 102 lap with respect to fingers 108 of adjacent hands 102. Each hand 102 moves independently.

Inflation of the plug 40 pushs the hands 102 out to engage the inner wall 122, FIG. 2, of the pipe 12 where they are stopped in positions causing the lower portion 88 of the restrainer 80 to have a frustro-conical shape, FIG. 2, holding peripheral parts of the plug 40 from passing upwardly around the outer edges of the restrainer.

In FIG. 1, the pressure assembly 70 is shown to have a gas-under-high-pressure container 130 in, and slidable vertically along the tube 12.

When a solenoid plunger assembly 134, diagrammatically shown in FIG. 1, is energized by a remote power supply, now shown, it presses the container 130 downward against an upwardly facing spear 138 mounted on a platform 140 fixed to the inner wall of the tube 30 and disposed inside the tube 30.

The platform 140 has vertical holes letting gas downward therethrough for plug inflation when the container 130 is punctuated by being pressed on the spear 138 by a plunger 146.

Figure 5:
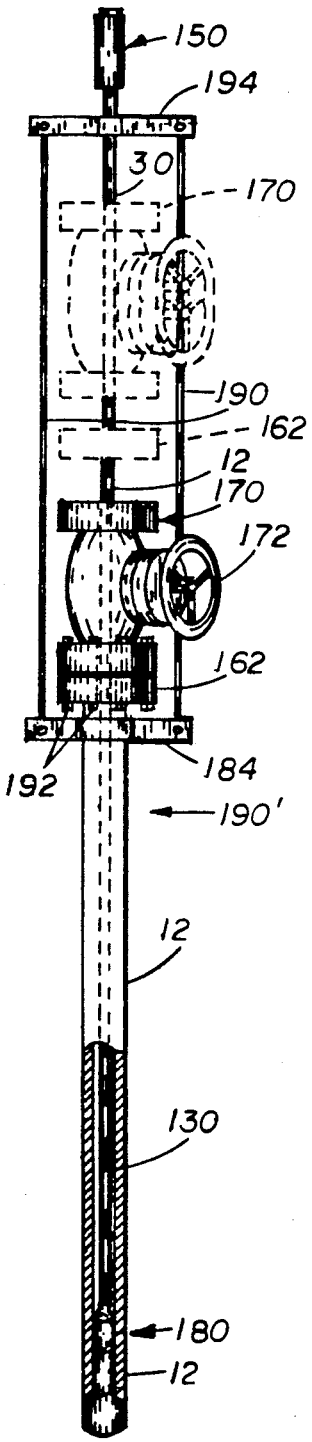
FIG. 5 shows the well casing of FIG. 1 partly broken away to show the plug. Also at the top of the casing a value and anchor flange are shown in dotted lines on the plug-tube from which they are lowered to the full line positions shown. A holding system shown holds the tube in fixed position with respect to the well casing.

In FIG. 5, a gas pressure delivery unit is shown at 150 and delivers gas to the upper end of the tube 30 serving the same purpose as the tube 30 of FIG. 1. The unit 150 delivers gas to a vertical tube 30 which extends downwardly through a gate valve 170 having a control handle 171.

The tube 30 also extends through an attachment flange 162 and from there extends through an upper end of a pipe 12 which can be a vertical oil well casing. At the lower end of the tube 30 is a plugging system 180 which can be of the type shown in FIGS. 1 and 2, although it is only grammatically shown in FIG. 5.

Around the upper end of pipe 12 is a lower clamp 184 which has connectors 190 extending therefrom, and being at their upper ends connected to an upper clamp 194 which latter is tightly fastened about the tube 30.

The tube 30 is passed downward into the pipe 12. Then the clamp 184 is clamped onto an upper part of the pipe 12 at a place spaced from the top thereof.

Then the flange is welded onto the top of the pipe 12. So that a circular sealing weld is made around the pipe at 190.

The gate valve is attached to the flange 162 by bolts 192 each of which extend through one of many vertical holes in the lower end of the gate valve which are in registry each with another vertical hole through the flange 162.

Installation can be done in more than one way. In one way of installation, the tube 30 is lowered into the pipe 12 when the flange 162 and gate valve 170 are already slidably disposed on the tube 30 but are supported on the tube by removable means, not shown, temporarily, during the lowering of the tube 30 into the pipe.

After the tube 30 is in the pipe 12, then the device not shown, for holding flange 162, in place on the tube 30, is removed allowing the flange 162 to slide down into position, resting on top of the pipe 12.

Next, welding is done around the pipe at 190' to attach the flange 162 to the pipe.

After that, the valve 170 is released so that it can be allowed to slide down to engage the flange 162. Then bolts 192 are installed through holes in the valve 172 and flange 162 to fix the gate valve 172 to the top of the flange 162. Lastly, the clamps 184 and 194 can be installed together with the connection rods or connectors 190.

Figure 6:
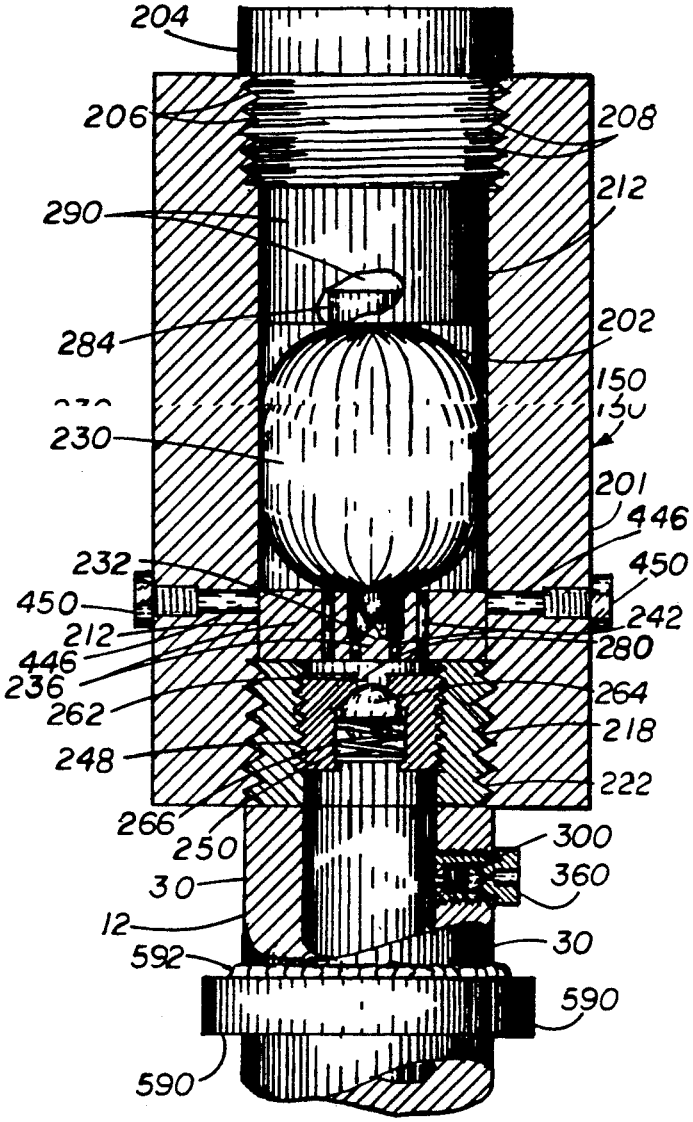
FIG. 6, shows a detail of a tube pressure holding and remotely controllable pressure release system with parts broken away.

In FIG. 6 a detail of the gas supply assembly 150 is shown. Its housing 201 has a vertical opening 202 therethrough. At the upper end of the opening 202 is a plug 204 with external threads 206 threadedly securing the plug 204 to other threads 208 on the upper end of the inner wall of the opening 202.

At the lower end of the opening 202 are threads 218 which receive the threads 222 of a threaded upper end of the tube 30. Inside the opening 202 is a container 230 for gas under pressure. At the underside of the container 230 is a spear 232 on a platform 236 which is suitably fixed to the inner wall 212 of the opening.

The platform 236 has openings 242 therethrough extending vertically for letting gas from the container 230 pass downwardly into a check valve opening 248 which opening extends vertically through the check valve housing 250 suitably secured to the tip of the tube 30, and plugging the top of the tube 30, and fixed therein by suitable means, not shown.

In the check valve housing 250 is a check valve seat 262 receiving a check valve ball 264 urged upwardly into a closed position in the seat 262 by an urging spring 266. The seat 262 gas an opening 280 extending upwardly and it is adapted to receive pressure through a gas opening 242 through the platform 236, whereby, when the check valve ball 264 is in a downward open position, gas can pass from the container 230 through the gas openings 242 and past the check valve ball 264 into the tube 30.

In FIG. 6, rupturing of the gas container 230 happens when it is pushed downwardly by a plunger 284 of a solenoid and plunger assembly 290.

In FIG. 6, a second ball check valve for pressure release is shown at 300 and when depressed by means, not shown, can release pressure from the tube 30 until the gas is out of it for deflating the plugging system 180 of FIG. 5.

The tube pressure release valve 300 extends out through a side of the upper part of the tube 30 beneath the housing 201.

Figure 7:
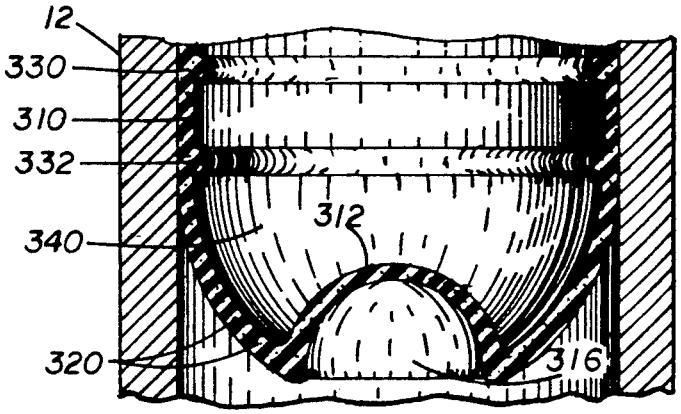
FIG. 7 is a detail of a modified plug-lower-portion in a well casing, with forward halves of each broken away.

In FIG. 7, a special plug 310 is shown having a concave inner and lower wall 312 having a downwardly opening cavity 316 so that oil pressure catching in the cavity 316 will tend to cause the lower end of the plug to be drawn upwardly at its center. This causes the plug 310 to tend to spread out less horizontally to prevent the tendency of parts of the plug to travel upwardly around outer edges of a restrainer not shown in FIG. 7, such as the restrainer of FIG. 1. Although the restrainer is not shown in FIG. 7, it could be above the parts shown in FIG. 7.

In FIG. 7, steel reinforcing such as used in automobile tires can extend throughout the plug as seen at 320 when the plug is seen in cross-section.

As the plug 310 is otherwise made of resilient material, such as rubber, therefore, it is flexible, and can move from an upper outer storage position as in FIG. 1 to the pipe plugging position of FIG. 2.

To further tend to prevent the plug 310 from passing upwardly around the lower end of the tube 30, certain reinforcing ribs 330 and 332 can be used. The ribs 330 and 332 are actually thicker parts of the wall of the plug 310 made by horizontal circular hollow centers surrounding protrusions 330 extending inwardly from the wall of the plug 310 into its hollow interior 340.

Fluid under pressure for plug expansion can be gas but it could also be any other fluid, such as a liquid and water would do the job.

Figure 8:
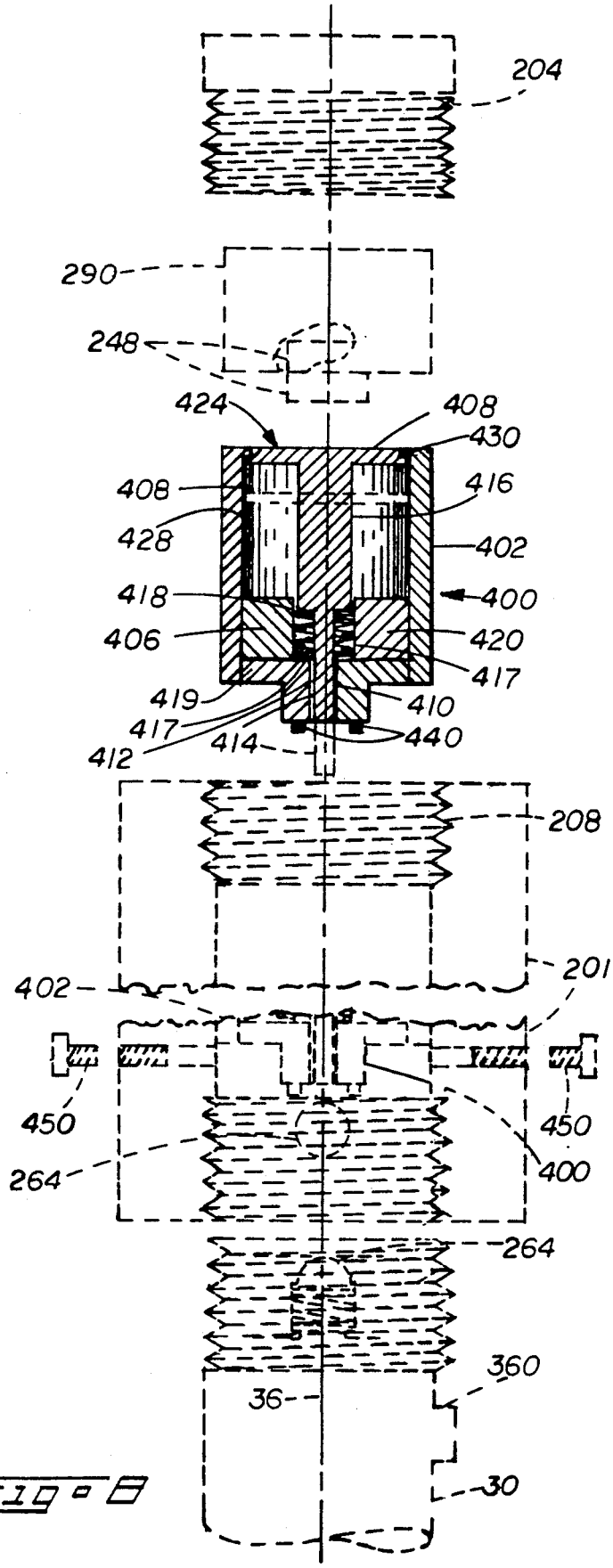
FIG. 8 is an exploded view of a remotely-controllable plug-tube-pressure-release-valve ball depressing system, shown in full lines in valve non-operating positions and in dotted lines in valve releasing position. This system replaces the air-pressure container and spear for pressure release mode. Near the top of FIG. 8, in dotted lines, is the same solenoid-plunger unit of FIG. 6, which is used to puncture an air pressure container by pressing it against a spear, but in FIG. 8, is used to depress a valve opener.

In FIG. 8, apparatus is shown for releasing gas pressure through the check valve 264 of FIG. 6. Such gas release is in the safest direction, which is vertical, straight upward.

To prepare for pressure-releasing, the plug 204 is removed from the tube 30.

Next, the solenoid-plunger assembly 290 is removed, then the container 230 of FIG. 6 and the platform 236, of FIG. 6, are both slid up and out of the tube 30. This is possible because the check valve ball 264 is holding back the great pressure.

Next, in FIG. 8, a valve-opener assembly 400 having a carrier or jacket 402 is slid down the tube 30 into the dotted line position in FIG. 8, resting on the check valve housing 250.

Next, the solenoid-plunger assembly 290 is then replaced into the tube 30 and the plug 204 is threaded back into place.

The valve-opener assembly 400, FIG. 8 has a jacket 402 having a larger upper opening 408 and a smaller lower opening 410.

The smaller opening 410 has a cylindrical wall 412 snugly slidably receiving and guiding a valve opening pressor 414 small enough to engage, and press into open position, the check valve ball 264 at times when the pressor 414 is in a down position as in dotted lines at the bottoms of the full-line, FIG. 8 upper, representation of the valve opener assembly 400.

The pressor 414 is connected to a vertically sliding pressor extension 416 of larger diameter than the pressor 414 and slidable in a bearing 420 attached to, and in, the lower end of the jacket 406.

At the top end of the pressor extension 416 is a push-head 424 which is of much larger diameter than the extension 416.

The push-head 424 is snuggly slidable vertically in a chamber 430 having a cylindrical wall 428, and is restrained by a circular ledge 430 to keep it in the jacket 406.

The solenoid-plunger assembly 290 of FIG. 8 is the same unit as shown in full lines in FIG. 6 and, when energized, is capable of pressing, with the plunger 284, the push-head 424 to cause the pressor 414 to open the valve.

The pressor extension 416 has a portion of lesser diameter called the valve opening pressor 414 snuggly fitting the smaller opening 410 whereby a spring 417 in a spring chamber 418 will exert a force against a lower wall 419 of the jacket 402 and against the pressor extension 416 for urging the pressor extension 416 and the push-head 424 upwardly to maintain the parts in the full line position of FIG. 8 for allowing the valve ball 264 of FIG. 8 to be in a closed position but when pressure from the solenoid plunger 248 presses the push-head 424 downwardly then the pressor 14 will be in the downward position shown in dotted lines in FIG. 8, wherein it holds the valve ball 264 in a valve open position.

The push-head 424 is snuggly slidable vertically in a chamber 430 having a cylindrical wall 428, and is restrained by a circular ledge 430 to keep it in the jacket 406.

When the valve-ball 264 is in open, downward, position

Gas pushing up past the valve ball 264 in FIG. 8, will flow past small spacer protrusions 440 and out through threaded ports 446 of FIGS. 6 and 8, at times when port-bolts 450 are removed as in FIG. 8.

When deflation of the plug 40 is complete, oil in the well-pipe 12 will rush up the well pipe 12, but this is temporary and harmless and will continue as the tube 30 is removed by a crane, not shown, or is pushed out by oil pressure out of the top of the gate valve 170 of FIG. 5.

Next, the gate valve 170 is closed and the work is then completed as flow is under complete control.

All this is possible because the flange 162 is welded to the circumference of the oil-well-pipe 30 holding the gate valve onto the oil well pipe, all while the plug 40 has oil-flow safely stopped.

In FIG. 8, an oil well casing 12 is shown with its upper end 502 far below ground level 504 where it is impossible to see the end 502 through the oil 506 in a cavity 508.

To help guide the tube 30 so that its plug 40 enters the oil-hidden top of the casing 12, a conical guide 510 is provided having a guide surface 512 inwardly inclining toward the tube axis 36, as the upper end of the surface 512 is approached.

The lower end of the guide surface 512 is of a substantially larger size than the well casing 12, to be easy for the guide surface 512 to be placed over the well casing 12 by means not shown.

The tube 30 is held centrally in the guide 510.

Figure 10:
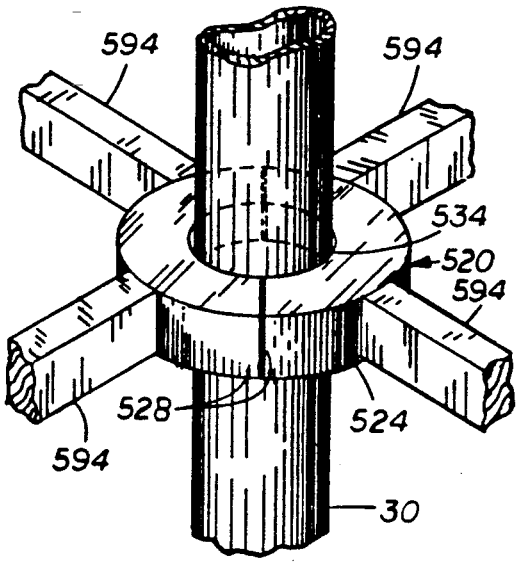
FIG. 10 is a detail showing an upper guide-spacer on a plug-tube-section, in perspective, with ends of legs broken away.

This partly done by an upper tube-positioner or spacer 520 having a central upper collar 524 having right and left half-sections 528 forming, when closed, FIG. 10, a vertical opening 534 which closely fits the tube 30.

Figure 9:
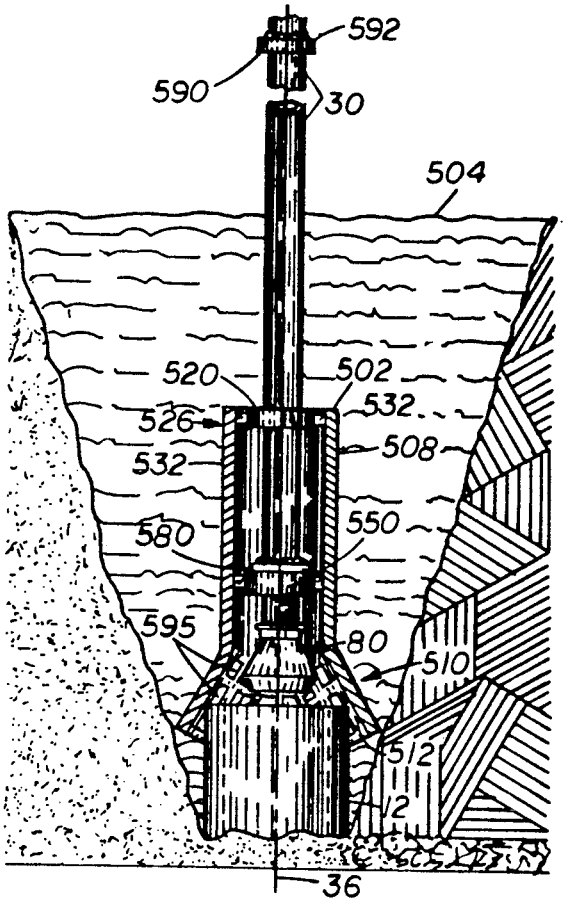
FIG. 9 is a diagrammatic side elevation of a plug-tube-guide shown with a forward side removed and shown as attached to a plug-tube and in guiding position on an oil well pipe.
Figure 11:
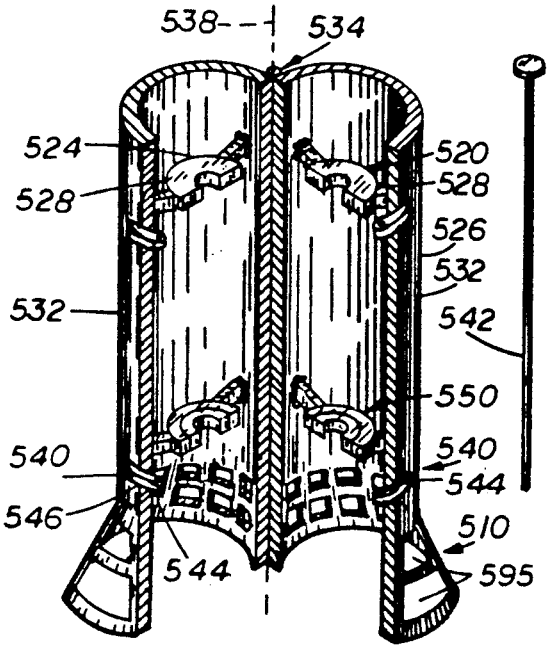
FIG. 11 is a perspective view of the guide in open disconnected position ready for removal from or attachment to a pipe.

A guide-frame 526, FIGS. 9 and 11, extends upwardly along the tube 30 from the conical guide 510 and has right and left frame sections 532 which, as seen in FIG. 11 are secured by a hinge 534.

The hinge 534 is at the rearward sides of the frame sections 532 for a pivoting about a vertical hinge-axis 538. The collar half sections 532 are held together at their forward ends by a releasable fastener 540 using a vertical pin 542 fitting in holes 544 of clasp lugs 546. The removal of the pin 542 from the lugs 546 permits opening of the guide 510 so that it can be removed from the tube 30.

The upper collar right half is secured to the guide-frame right section by a pair of braces.

The positioning of the tube 30 is further helped by a lower tube positioner 550.

Figure 12:
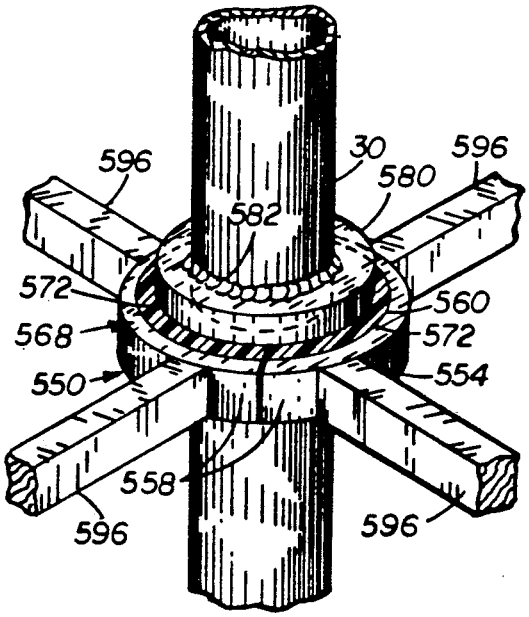
FIG. 12 is a perspective view of a tube section with the lower guide-supporting-plug-tube spacer thereon. A slower tube positioner is shown with a shearable liner between the collar and the tube which engages a flange on the tube. A portion of a flange liner is broken away to show that the shearable liner extends completely under the flange and clear to the tube.

The lower tube-positioner 550 has a central lower collar 554 best seen in FIG. 12 having right and left half sections 558, forming, when in collar closed position, FIG. 12, a vertical opening 560 which closely fits the tube 30. The collar 554 is formed at two parts, a strong outer portion and shearable liner assembly 568 having right and left half-sections 572.

In FIG. 12, a guide holding flange 580 extends around the tube 30 and is welded hereto at 582 to resist upward movement of the guide under the pressure of upwardly gushing oil.

The flange 580 gauges an upper side of the shearable liner assembly 568 and prevents upper movement of the guide if the liner 568 is not sheared.

The liner assembly 568 can be formed of a shearable babbitt metal or of thermal plastic, whatever has a sufficient strength to resist the pressure of gushing oil onto the guide sufficient to hold the guide in place on the tube 30.

As the guide is lowered with the tube 30 inside, the guide surface 512 will be easily centerable onto the top of the well casing 12.

Thereafter a downward motion of the tube 30 such as caused by mechanical means not shown will force the flange 580 against the shearable liner 568 causing it to shear. This shearing will allow then the tube 30 and its restrainer 80 to move on down into the casing 12, even though the guide 510 will not go down further.

In fact the guide 510 being freed from the flange 580 will move upward under the pressure of the gusher until such time as its upper collar 520 strikes a stop 590 fixed to the tube 30 as in FIG. 6 although perhaps easier seen in FIG. 9 where a similar stop 590 is fixed to the tube 30 by welding as at 592.

The conical guide 510 is seen in FIGS. 9 and 10 to have large openings 595 in it. These are permitted to allow oil to past therethrough to reduce the effective force of a gusher against the guide 510.

The collars 524 and 554 are connected by braces 594 and 596 respectively extending out to the inner side of the frame sections 532, to which latter of the braces are attached whereby each collar 524 and 554 is disposed centrally about the axis 36 as is also the guide surface 512, of the tube 30 and the restrainer 80.

In operation, first the oil can be bailed from the cavity 508 in order to be able to remove dirt away from the top of the oil casing 12; and next the tube 30 is lowered until the guide surface 512 has been received on the top of the pipe or oil casing 12. Next the tube 30 is pressed downward with sufficient force that its flange 512 shears the liner 572 causing parts to fall away.

The tube 30 is then pushed downwardly shearing the liner assembly 568, and then is pushed further downwardly until the restrainer 80 of FIG. 9 is in a desired position for the inflation of the plug.

At the time of the lowering or pressing down of the tube 30, the valve 170 of FIG. 5 and the flange 162 thereof are slidably disposed on the tube 30 of FIG. 5.

Next as seen in FIG. 6 an inflation system is put in operation, as it is disposed at the upper end of the tube 160 of FIG. 6 when the tube is pressed down towards the oil casing in the first place.

By operating the solenoid 290 of FIG. 6 by remote control, its plunger 284 presses downwardly on the pressurized gas container 230 causing it to be punctured against the spear 232 for releasing gas under pressure therefrom so that it passes through the passages 242 depressing the valve ball 264 and inflating the plug 40 or the modified plug 310 on FIG. 7, so that it moves from the storage position of FIG. 1 outwardly of the tube to plug the pipe or well casing 12.

With the well casing 12 securely plugged, the clamps 184 and 194 with connecting rods 190 can be put in the positions of FIG. 5.

Next, the flange 162 in FIG. 5 can be lowered to be around the upper side of the tube 30 where it is secured to the tube by means of welding at 190 prime. The clamps 184, 194, and the rods 190 can then be removed.

Next the tube 12 is removed upwardly through the valve 170 and taken away. During this a momentary escape of oil will occur.

The valve 170 is then shut and piping not shown can be connected for normal oil well operation.

I claim:

1. A pipe plugging system for plugging a pipe having an outer end which is open and accessible and having an inner portion, comprising: a plug-carrying tube having an outer end and an inner end, said inner end being insertable into a pipe, the inner end of said tube being straight, said tube having a central axis, an inflatable resilient flexible plug having inner and outer ends, said plug having its outer end open and has its inner end closed, the inner end of said plug being inflatable for plugging a pipe, said plug defining an enclosure with a hollow interior, said plug having a hollow neck at its outer end and attached to said inner end of said tube whereby said neck can receive fluid from said tube and can deliver fluid to said hollow interior of said plug, means attaching said neck to the inner end of said tube and capable of holding said neck onto said tube and of permitting an inflation means to deliver fluid under pressure into said plug to inflate an inner portion of said plug by a fluid from said tube whereby said pipe becomes plugged by expansion of said inner end portion of said plug, a restrainer having an outer end attached to the inner end of said tube and surrounding a portion of said plug during pipe plugging, plug-inflated times, said restrainer having an inner end farthest from said outer end of said tube.

2. The pipe plugging system of claim 1 having a restrainer having an outer end attached to the inner end of said tube and surrounding a portion of said plug during pipe plugging, plug-inflated times, said restrainer having an inner end farthest from said outer end of said tube.

3. The pipe plugging system of claim 1 having said restrainer having an upper section called a base which is substantially stationary with respect to said tube and a plurality of blockers, said blockers each having an upper portion hinged to said base in a manner for pivoting substantially about an individual axis transverse to said tube axis whereby lower ends of said blockers can swing outwardly away from said tube axis to at least be very close to the inner wall of a pipe when pushed away from said axis by said restrainer as it inflates each of said blockers having lapping-portions, at plug-inflated times said lapping portions of each blocker lapping lapping-portions of two adjacent blockers, said inner end of said restrainer being movable with respect to said tube and capable of assuming a contracted position during plug-deflated times with all parts of an innermost portion of said restrainer closer to a tube-center of the inner end of said pipe and capable of assuming an expanded restraining position with all parts of said inner end of said restrainer farther from said central axis of said tube, said restrainer substantially surrounding a portion of said plug farthest from said tube axis whereby a portion of said plug can move during plug inflation through said restrainer in a direction away from said base of said restrainer, said plug having a periphery portion spaced from said axis during plug-inflated times, when said lower end of said restrainer is in restraining position, through said restrainer in a direction away from said base of said restrainer, said plug having a periphery portion spaced from said axis during plug-inflated times, when said lower end of said restrainer is in restraining position and said plug is in an inflated state said restrainer being capable of blocking said plug so that the majority portions of the periphery of said plug substantially cannot pass into unwanted positions on the outer side of said restrainer above the lower end of said restrainer when a pipe receiving said restrainer and said plug is of such a size as to provide a close fit with respect to said lower end of said restrainer whereby said blockers form a rigid blocking wall restraining said plug from passing said restrainer into said unwanted positions.

4. The pipe plugging system of claim 1 having a container of gas under pressure disposed above said restrainer and means for releasing pressure from said container so that it can put gas pressure into said tube above said restrainer whereby such pressure can cause inflation of said plug.

5. The pipe plugging system of claim 4 said plug having a concavity in its wall at that end thereof which is farthest from said tube when said plug is in said inflated position.

6. A pipe plugging system for plugging a pipe having an outer end which is open and accessible and having an inner portion, comprising: a plug-carrying tube having an outer end and an inner end, said inner end being insertable into a pipe, the inner end of said tube being straight, said tube having a central axis, an inflatable resilient flexible plug having inner and outer ends, said plug having its outer end open and has its inner end closed, the inner end of said plug being inflatable for plugging a pipe, said plug defining an enclosure with a hollow interior, said plug having a hollow neck at its outer end and attached to said inner end of said tube whereby said neck can receive fluid from said tube and can deliver fluid to said hollow interior of said plug, means attaching said neck to the inner end of said tube and capable of holding said neck onto said tube and of permitting an inflation means to deliver fluid under pressure into said plug to inflate an inner portion of said plug by a fluid from said tube whereby said pipe becomes plugged by expansion of said inner end portion of said plug, said plug having a concavity in its wall at that end thereof which is farthest from said tube when said plug is in said inflated position.

7. The pipe plugging system of claim 3 said plug having a concavity in its wall at that end thereof which is farthest from said tube when said plug is in said inflated position.

8. A pipe plugging system for plugging a pipe having an outer end which is open and accessible and having an inner portion, comprising: a plug-carrying tube having an outer end and an inner end, said inner end being insertable into a pipe, the inner end of said tube being straight, said tube having a central axis, an inflatable resilient flexible plug having inner and outer ends, said plug having its outer end open and has its inner end closed, the inner end of said plug being inflatable for plugging a pipe, said plug defining an enclosure with a hollow interior, said plug having a hollow neck at its outer end and attached to said inner end of said tube whereby said neck can receive fluid from said tube and can deliver fluid to said hollow interior of said plug, means attaching said neck to the inner end of said tube and capable of holding said neck onto said tube and of permitting an inflation means to deliver fluid under pressure into said plug to inflate an inner portion of said plug by a fluid from said tube whereby said pipe becomes plugged by expansion of said inner end portion of said plug, an annular flange surrounding said tube, connection means connecting said flange to the circumference of said pipe in a manner preventing fluid flow between said flange and said pipe, a gate valve having substantially a flow passage therethrough, said tube extending through said gate valve, connection means connecting said valve to said flange for fluid flow through said valve and through said flange.

9. The pipe plugging system of claim 1 having said inner end of said restrainer being movable with respect to said tube and capable of assuming a contracted position during plug-deflated times with all parts of an innermost portion of said restrainer closer to a tube-center of the inner end of said tube and capable of assuming an expanded restraining position with all parts of said inner end of said restrainer farther from said central axis of said tube, said restrainer surrounding an outer portion of said plug whereby a portion of said plug can move during plug inflation through said restrainer, said plug having a periphery portion spaced from axis during plug-inflated times, when said lower end of said restrainer is in restraining position and said plug is in an inflated state said restrainer being capable of blocking said plug so that the majority of the periphery of said plug portions substantially cannot pass into unwanted positions on the outer side of said restrainer above the lower end of said restrainer when a pipe receiving said restrainer and said plug is of such a size as to provide a close fit with respect to said lower end of said restrainer.

10. The pipe plugging system of claim 1 having said plug having a central portion capable of substantially being received into the adjacent end of said tube before inflation of said plug and of moving inwardly along said tube as a result of inflation.

11. The pipe plugging system of claim 1 having said plug being of sufficient strength as to withstand without rupturing pressures sufficient for said plug to restrain the pressures of a natural underground well of fossil fuel such as oil and/or natural gas.

12. A pipe plugging system for plugging a pipe having an outer end which is open and accessible and having an inner portion, comprising: a plug-carrying tube having an outer end and an inner end, said inner end being insertable into a pipe, the inner end of said tube being straight, said tube having a central axis, an inflatable resilient flexible plug having inner and outer ends, said plug having its outer end open and has its inner end closed, the inner end of said plug being inflatable for plugging a pipe, said plug defining an enclosure with a hollow interior, said plug having a hollow neck at its outer end and attached to said inner end of said tube whereby said neck can receive fluid from said tube and can deliver fluid to said hollow interior of said plug, means attaching said neck to the inner end of said tube and capable of holding said neck onto said tube and of permitting an inflation means to deliver fluid under pressure into said plug to inflate an inner portion of said plug by a fluid from said tube whereby said pipe becomes plugged by expansion of said inner end portion of said plug, a closable valve surrounding said tube and slidable along said tube, as a flange means for valve attachment to a pipe, said flange means surrounding said tube and attachable to the outer end of a pipe and being slidable along said tube and being disposed inwardly along said tube from said valve, said valve being closable by forces applyable against its exterior.

13. A pipe plugging system for plugging a pipe having an outer end which is open and accessible and having an inner portion, comprising: a plug-carrying tube having an outer end and an inner end, said inner end being insertable into a pipe, the inner end of said tube being straight, said tube having a central axis, an inflatable resilient flexible plug having inner and outer ends, said plug having its outer end open and has its inner end closed, the inner end of said plug being inflatable for plugging a pipe, said plug defining an enclosure with a hollow interior, said plug having a hollow neck at its outer end and attached to said inner end of said tube whereby said neck can receive fluid from said tube and can deliver fluid to said hollow interior of said plug, means attaching said neck to the inner end of said tube and capable of holding said neck onto said tube and of permitting an inflation means to deliver fluid under pressure into said plug to inflate an inner portion of said plug by a fluid from said tube whereby said pipe becomes plugged by expansion of said inner end portion of said plug, an attacher attached to said tube toward the outer end of said tube from said valve and having means attached to a pipe and disposed on the inner side along said tube from said valve.

* * * * *